United States Patent [19]

Robinson

[11] 3,946,457

[45] Mar. 30, 1976

[54] MOP WRINGER

[75] Inventor: Paul E. Robinson, Largs Bay, Australia

[73] Assignee: S.A. Brush Company Limited, Albert Park, Australia

[22] Filed: Sept. 18, 1974

[21] Appl. No.: 506,982

[30] Foreign Application Priority Data

Mar. 22, 1974 Australia ..... 6990/74

[52] U.S. Cl. ..... 15/119 R; 15/262

[51] Int. Cl.[2] ..... A47L 13/144

[58] Field of Search ..... 15/116 R, 116 A, 119 R, 15/119 A, 262

[56] References Cited

UNITED STATES PATENTS

| | | | |
|---|---|---|---|
| 348,033 | 8/1886 | Miller | 15/119 R |
| 641,744 | 1/1900 | Westrup | 15/262 |
| 1,709,622 | 4/1929 | Justis | 15/120 A |
| 2,023,021 | 12/1935 | Jenkins | 15/119 R |
| 2,521,445 | 9/1950 | Brown | 15/119 R |
| 3,462,788 | 8/1969 | Abbott | 15/119 R |

*Primary Examiner*—Daniel Blum

*Attorney, Agent, or Firm*—Oldham & Oldham Co.

[57] ABSTRACT

A mop wringer for cotton and like mops, the wringer being a tubular member adapted to slide on the mop handle, and having a pair of rollers mounted in inclined slots at the lower end of the tubular member so that as the tubular member is moved downwardly up over the mop the rollers engage the mop to roll thereon and move along the slots so that the rollers move towards each other to squeeze the liquid from the mop.

4 Claims, 4 Drawing Figures

MOP WRINGER

This invention relates to a wringer for a mop and more particularly to a wringer which is light and easy to use.

BACKGROUND OF THE INVENTION

The purposes of a mop made with strands or lengths of twisted cotton, viscose, nylon or other suitable fibre, natural or synthetic, are mainly the washing of surfaces usually floors and/or the absorption or taking up of fluids including those perhaps accidentally spilt. For these purposes it is necessary continuously to remove by wringing out the suds, water or other fluid previously absorbed or taken up.

Various devices are known for these purposes with the object of eliminating wringing out by hand and these devices include a wringer mechanism on a bucket so that the mop can be squeezed between rollers while being removed from the bucket. Another device includes a sleeve-like member on the mop itself and into which the mop can be drawn so that the mop is compressed by the surface of the sleeve.

However not all such devices are completely successful and it is an object of this invention to provide a mop wringer which is light, easily operated, and yet effectively removes water from the mop.

A further object is to provide a wringer which will squeeze the mop to effectively remove water from the mop and yet while being permanently attached to the mop does not inconvenience the user in the normal use of the mop.

Thus the invention includes a wringer adapted to be fitted to a mop, the wringer being adapted to slide along the mop and having means to engage the mop during movement in the direction of the mop head to squeeze the water therefrom.

Also the invention can include a combination mop and wringer, the wringer being slidable along the mop and being tubular with roller means to engage the brush and apply a squeezing action to the mop as the wringer moves to and over the mop.

DESCRIPTION OF THE PREFERRED EMBODIMENT

Figure 1:
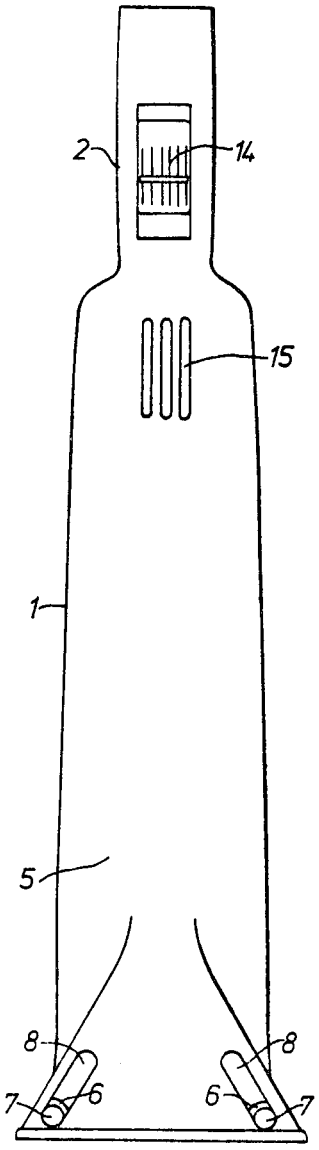
FIG. 1 is a side view of the wringer.
Figure 2:
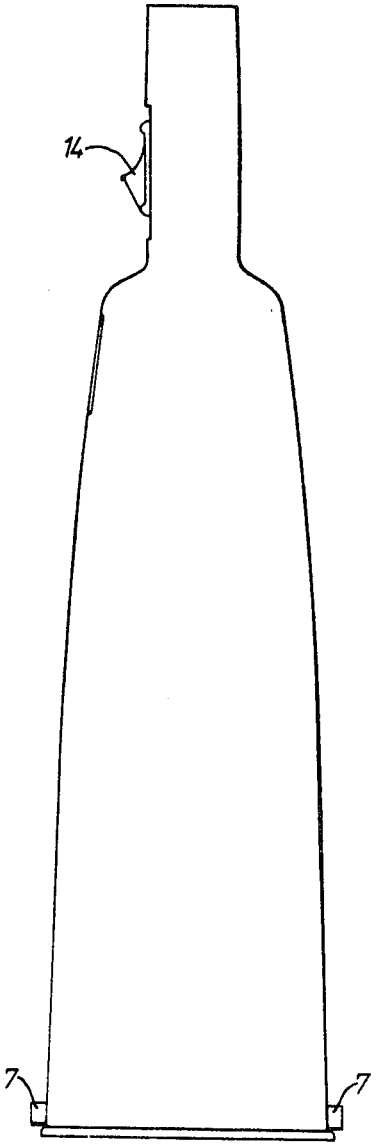
FIG. 2 is a further side view.
Figure 3:
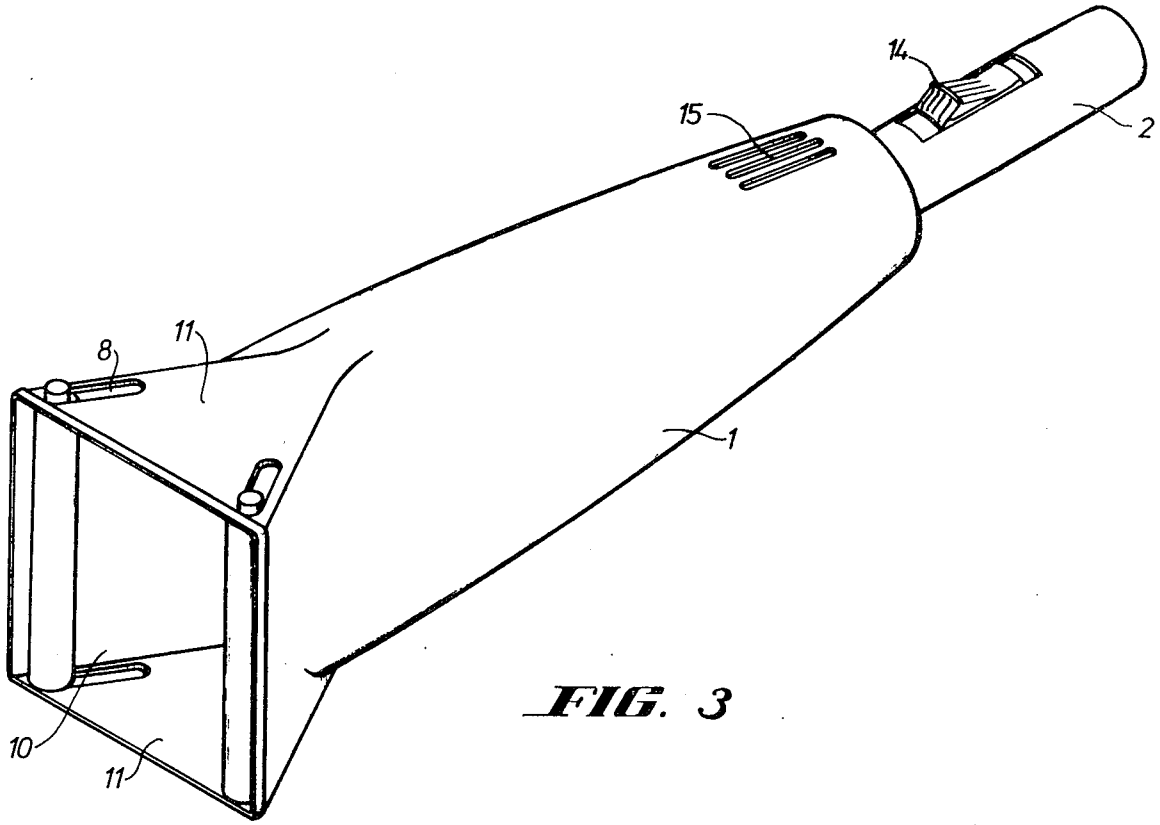
FIG. 3 is a perspective end view.
Figure 4:
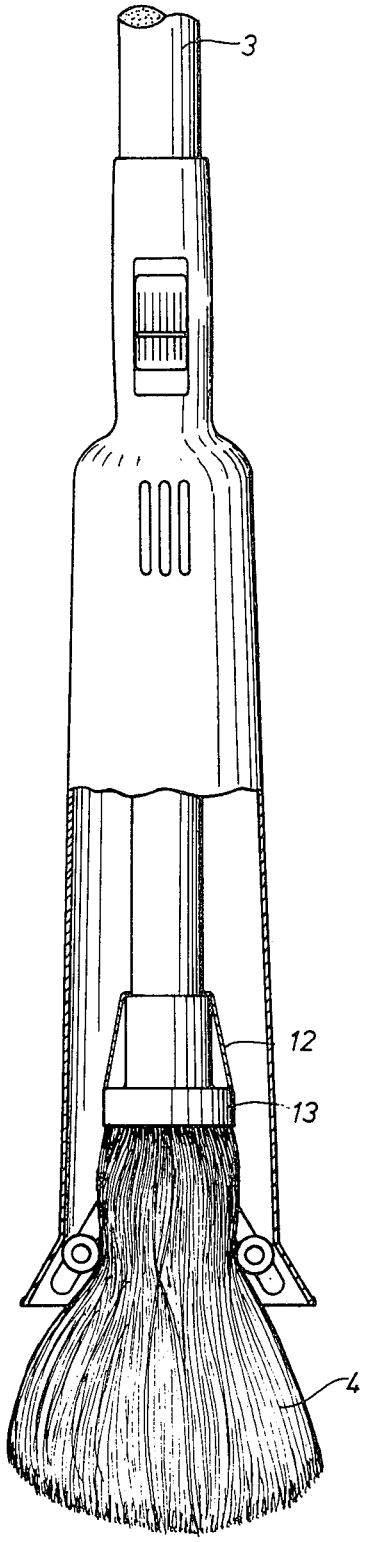
FIG. 4 is a part sectional view showing the action of the wringer on a mop.

In its preferred form the wringer 1 can comprise a basically tubular member, having at one end a sleeve-like portion 2 to loosely slide along the handle 3 of the mop 4. The tubular portion 5 at its lower or open end is provided with squeezing means in the form of rollers 6 which engage the mop, and as the wringer is moved downwardly the rollers apply a squeezing action to the mop. Preferably, the rollers can comprise a pair of rollers which move towards each other as they pass over the mop.

By providing the rollers with stub axles 7 or the like which can move in inclined slots 8 the action of the mop on the rollers cause the rollers 6 to roll along the slots 8 and towards each other. Thus the slots 8 when looking at the wringer from the side diverge from each other in a downward direction or in other words towards the open end of the tubular member. Thus the rollers would be in the lowermost ends of the slots when the wringer is positioned upwardly along the handle, and when moved downwardly the rollers would engage the mop. On further downward movement the rollers by rolling on the mop itself will move along the slots and thus towards each other so providing an increasing squeezing action on the mop to effectively remove excess water from the mop.

The open end of the tubular member is preferably flared at 10 and to form a basically rectangular opening, so that the sides 11 of the member in which the slots are provided are substantially planar and parallel to each other.

Although the sleeve portion of the tubular member slides along the handle and thus guides the mop in its upward and downward movement, preferably there on the handle further guide means in the form of a tapered sleeve 12 adjacent the top of the mop 1 so that when the member is moved downwardly the rollers do not come into contact with the solid portion 13 of the top of the mop.

The rollers can be smooth or if desired small ridges, corrugations or flutes may be provided on the rollers so that a more positive action occurs to cause the rollers to rotate and thus move up the rollers to each other.

When the rollers move over the end of the mop on downward movement of the wringer away from the mop, inertia and/or gravity causes the rollers to jerk and drop to the lower ends of the slots so that the wet compressed mop can readily be moved downwardly to pass through the now spread apart rollers.

Thus in this way there is provided a self-squeezing action whereby it is merely necessary to move the member down over the mop and the rollers automatically squeeze the mop by moving up the slots to the innermost position.

The mop itself can be a known cotton mop, or can be formed with a socket moulded of suitable plastics material the socket having pairs of holes into which a staple or staples can be fixed, the staples passing through and over the strands of the mop so that by simply fixing the staples the mop strands are affixed to the socket to form the mop head.

Preferably the socket is moulded from one of the plastics materials possessing high strength and moisture resistance suitable for moulding, preferably nylon and and also the tubular member rollers forming the wringer are also formed of a suitable plastics material. Thus the tubular member when the mop is in use is light and does not appreciatively add to the weight of the mop and also it does not inconvenience the user in the use of the mop. If desired a stop may be provided to limit the sliding movement of the tubular member upwardly along the handle while the downward movement can be limited by the rollers resting on the mop itself or by a detent or the like to limit downward movement until the user pushes the wringer downwardly to cause the squeezing action.

As shown there is provided a sliding button 14, having a tongue adapted to be pressed against the handle by sliding over a guide or abutment so that the tongue can grip the handle to hold the wringer in the inoperative position. Vents 15 can be provided, if desired, so that air and possibly water can pass therethrough to allow easier operation of the wringer.

Although one particular form of the invention has been described it will be realized that various modifications and alterations thereof could be made without departing from the spirit and scope of the invention.

I claim:

1. A mop wringer comprising a flared, open ended tubular member having guide means adjacent its smaller end to guide the tubular member along the handle of the mop, and a pair of opposed substantially parallel rollers mounted in opposed guide slots in the tubular member, the slots being inclined to each other and situated at the larger end of the tubular member, the slots being more widely spaced from each other toward the larger end of the member whereby as the wringer is moved downwardly over the mop, the rollers engage the mop and due to the position of the slots the rollers move along the mop and automatically move along the slots to apply an increasing pressure to the mop.

2. A mop wringer as in claim 1, for a strand type mop and where each roller includes axle means movably mounted in the slots whereby the rollers drop down to the lower ends of the slots as the mop is pulled above the rollers when the tubular member is positioned on a substantially vertical axis, and the wet compressed mop can be passed downwardly between the rollers.

3. A mop wringer as defined in claim 1 wherein the tubular member has at its smaller end a sleeve member to slide along the mop handle, the slots being formed in parallel side portions of the larger end.

4. A mop wringer as defined in claim 1 wherein the mop head has a tapered portion to engage the rollers and to allow the rollers to ride over the mop head to engage the mop.

* * * * *